US006260457B1

(12) United States Patent
Hakkaku

(10) Patent No.: US 6,260,457 B1
(45) **Date of Patent: *Jul. 17, 2001**

(54) PRINTER CUTTER DEVICE

(75) Inventor: Kunio Hakkaku, Tokyo (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/145,306

(22) Filed: Sep. 2, 1998

(30) Foreign Application Priority Data

Sep. 3, 1997 (JP) ..... 9-252667

(51) Int. Cl.[7] ..... B26D 7/00
(52) U.S. Cl. ..... 83/167; 83/455; 83/614
(58) Field of Search ..... 83/156, 455, 614, 83/220, 167; 242/556.1, 553

(56) References Cited

U.S. PATENT DOCUMENTS

| | | | | |
|---|---|---|---|---|
| 3,463,040 | * | 8/1969 | Pouilloux | 83/614 X |
| 3,733,951 | * | 5/1973 | Fujimoto | 83/614 X |
| 4,353,274 | * | 10/1982 | Shimizu | 83/156 |
| 4,397,203 | * | 8/1983 | Brack et al. | 83/156 |
| 4,943,270 | * | 7/1990 | Fleckenstein | 83/167 X |
| 4,981,059 | * | 1/1991 | Kobayashi | 83/614 X |
| 5,379,668 | * | 1/1995 | Standing | 83/167 X |
| 5,442,983 | * | 8/1995 | D'Angelo et al. | 83/455 X |
| 5,503,053 | * | 4/1996 | Onishi et al. | 83/614 X |
| 5,611,253 | | 3/1997 | Saito et al. . | |
| 5,613,415 | * | 3/1997 | Sanpei | 83/455 X |
| 5,791,218 | * | 8/1998 | Saito et al. | 83/455 X |
| 5,881,623 | * | 3/1999 | Otani et al. | 83/455 |

FOREIGN PATENT DOCUMENTS 2 289 430 11/1995 (GB) .

* cited by examiner

*Primary Examiner*—M. Rachuba
(74) *Attorney, Agent, or Firm*—Sughrue, Mion, Zinn, Macpeak & Seas, PLLC

(57) ABSTRACT

A cutter device for use in a printer in which a broad continuous printing sheet is printed and thereafter the printed portion of the sheet is cut along a width direction to be dropped downward to a tray. The cutter devise includes a cutter which reciprocating to cut the printed sheet in the width direction; and holding member for holding the sheet to prevent the sheet from dropping on a cutting start side of the cutter. The sheet is released from the holding member substantially in synchronism with the completion of the cutting by the cutter. Preferably, the sheet is fed a reverse in rewinding direction before the cutter finishes cutting to return to its original position, so that the cut end of a non-printed sheet is prevented from interfering with the returning cutter. The compactness of the cutter device is achieved and the sheet charging operations are facilitated.

5 Claims, 6 Drawing Sheets

⟨RELEASE(SOLENOID OFF)⟩

⟨PRESS(SOLENOID ON)⟩

PRINTER CUTTER DEVICE

BACKGROUND OF THE INVENTION

1. Field of the Invention

The present invention relates to a cutter device in which after a broad continuous printing sheet drawn from a horizontally placed roll is printed, the printed sheet is cut with a reciprocating cutter.

2. Description of the Related Art

In a case where a continuous printing sheet drawn from a horizontally placed roll is printed and subsequently cut with a reciprocating cutter, the printed sheet cannot be cut clear if it moves. Moreover, when a broad sheet is used, a cut portion hangs down by the sheet's own weight during the cutting operation and an uncut portion is wrinkled or surged.

Therefore, since the sheet cannot be cut straight, a cut edge is curved, or the sheet may be torn at the vicinity of a terminal end of the cut edge. To solve the problem, a conventional printer is provided with a press bar for pressing the printing sheet over the entire width of the printing sheet, and the press bar is pressed against the sheet to fix the sheet immediately before the sheet is cut with the cutter.

In the conventional device, however, since the press bar usually transverses the entire width above the sheet, the device is large-sized including its operation mechanism. Especially, when the sheet has a large width, not only the press bar should be lengthened, but also the weight of the printed sheet must be increased, so that it is difficult to press the sheet uniformly over the entire length. Moreover, when the sheet is set, a front edge of the sheet has to be passed through a small gap under the press bar, and sheet charging operation is also laborious.

SUMMARY OF THE INVENTION

The present invention has been accomplished in consideration of circumstances described above, and an object thereof is to provide a cutter device which can achieve compactness to facilitate the sheet charging operation and which is suitable especially for a printer using a broad sheet.

To attain this and other objects, the present invention provides a cutter device for use in a printer in which a broad continuous printing sheet drawn from a horizontally placed roll is printed and the printed sheet is cut along its width direction, dropped downward and received by a tray. The cutter device is provided with a cutter which reciprocates to cut the printed sheet in its width direction, holding means interposed between the cutter and the tray for holding the sheet to prevent the sheet from dropping in the vicinity of a cutting start side of the cutter, and a controller for allowing the holding means to hold a cutting start end of the printing sheet substantially in synchronism with start of cutting by the cutter and for detaching the holding means from the printing sheet substantially synchronously with completion of the cutting by the cutter.

The holding means is provided with a guide plate for guiding the cut printing sheet to the tray, and a pressing member for pressing the printing sheet on a top surface in the vicinity of the cutting start side of the cutter against the guide plate. The controller allows the pressing member to press the printed sheet substantially synchronously with the start of the cutting by the cutter and hold the printing sheet between the pressing member and the guide plate, and detaches the pressing member from the printed sheet substantially synchronously with the completion of the cutting by the cutter.

Here, the controller preferably prevents the cutter from abutting on a cut edge of the sheet by feeding in reverse the printing sheet by a predetermined amount in the rewinding direction before the cutter finishes cutting to return to its original position. Moreover, the cutter includes a rotating blade which rotates at a high speed, and has a good sharpness, so that the entire width of the sheet can be cut at once at a high speed. The cutter preferably moves at a speed of about 0.5 to 2.0 m/sec. If cutting is performed at a high speed, by using the inertia of the sheet and the frictional resistance between the sheet and the guide member during cutting, cutting can be completed before the load of the sheet applied to the pressing member increases. Thus, the pressing force of the pressing member can be reduced.

After printing is completed, the sheet is fed by the predetermined amount to align a cutting position with a cutter position. Upon receipt of a cutting command, the controller presses the pressing member on the sheet to press an end of the printed sheet on the cutting start side. Substantially simultaneously or slightly late the cutter starts cutting the sheet, and moves at a high speed.

The controller detaches the pressing member from the sheet substantially synchronously with a time at which the cutter finishes cutting the sheet. Therefore, the entire width of the cut edge of the printed sheet starts dropping substantially simultaneously. Consequently, the edge cut by the cutter can be straight and clear without being curved.

DETAILED DESCRIPTION OF THE PREFERRED EMBODIMENT

Figure 1:
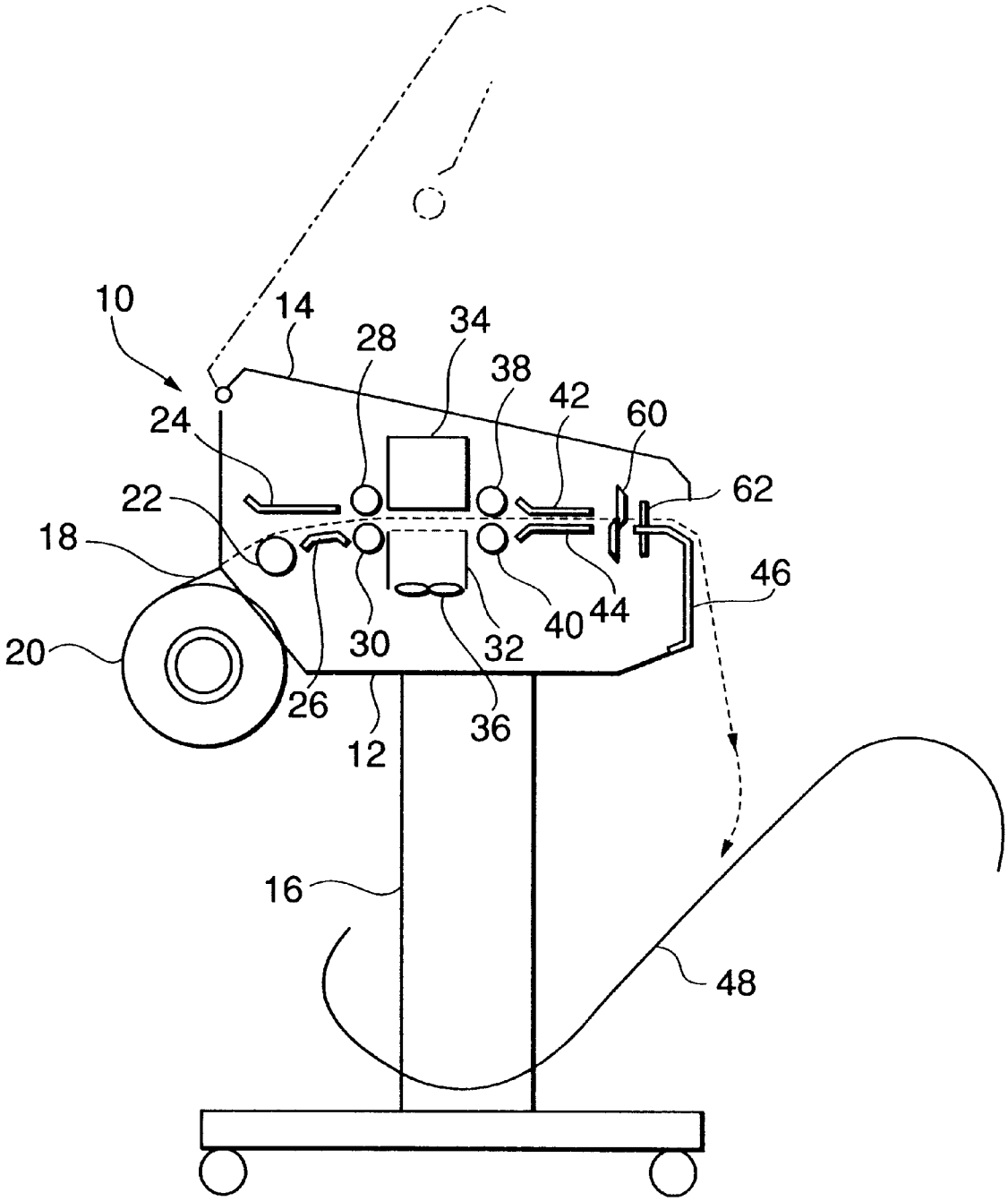
FIG. 1 is a side view diagrammatically showing a printer employing a cutter device according to an embodiment of the present invention.

In FIG. 1, a reference numeral 10 denotes a printer unit which is housed in a longitudinal case 12, and a top surface of the case 12 forms a lid 14 which is able to be opened upward. The case 12 is supported by a pair of opposite legs 16. A roll 20 with a printing sheet 18 wound therearound is held horizontally in width direction of the case 12 at the back downside of the case 12. The printing sheet 18 is guided from the roll 20 into the case 12, and printed in the case 12. The printing sheet 18 is used as a poster or the like, its width is broad, and the maximum width of about 54 inches is used.

The printing sheet 18 is guided by a guide roller 22 to a gap between a pair of upper and lower guide plates 24 and 26, further held between a pair of upper and lower feed rollers 28 and 30, and fed toward a front face of the case 12. While the printing sheet 18 is rested on a platen 32, printing is performed by a print head 34 which moves along the top surface of the printing sheet 18 in the width direction (transverse direction). Additionally, the platen 32 has multiple small holes on its top surface, and the small holes are sucked to a negative pressure by an evacuate fan 36. Therefore, the printing sheet 18 is sucked onto a surface of the platen 32 by a suction pressure acting on the small holes, and fixedly adheres to the surface of the platen 32.

The print head 34 is of a piezo-ink jet system in which a piezoelectric element pressurizes a slight amount of ink to eject ink droplets to the printing sheet 18, and four color ink ejecting nozzles of cyan, magenta, yellow and black are arranged in feeding direction of the printing sheet 18. The print head 34 may be of a system other than the piezo-ink jet print system. For example, a bubble jet print system for heating ink to jet ink drops, a heat transfer recording system, or the like may be used. The print head 34 moves along the top surface of the printing sheet 18 held by the platen 32 in the width direction to print the printing sheet 18.

The printing sheet 18 is passed under the print head 34, fed between a pair of upper and lower sheet rollers 38 and 40 to be discharged from the printer section, further passed between a pair of upper and lower guide plates 42, 44, and guided downward by a guide plate 46. The printing sheet 18 is placed into a large-sized basket-like tray 48 which is attached between the pair of opposite legs 16.

Figure 2:
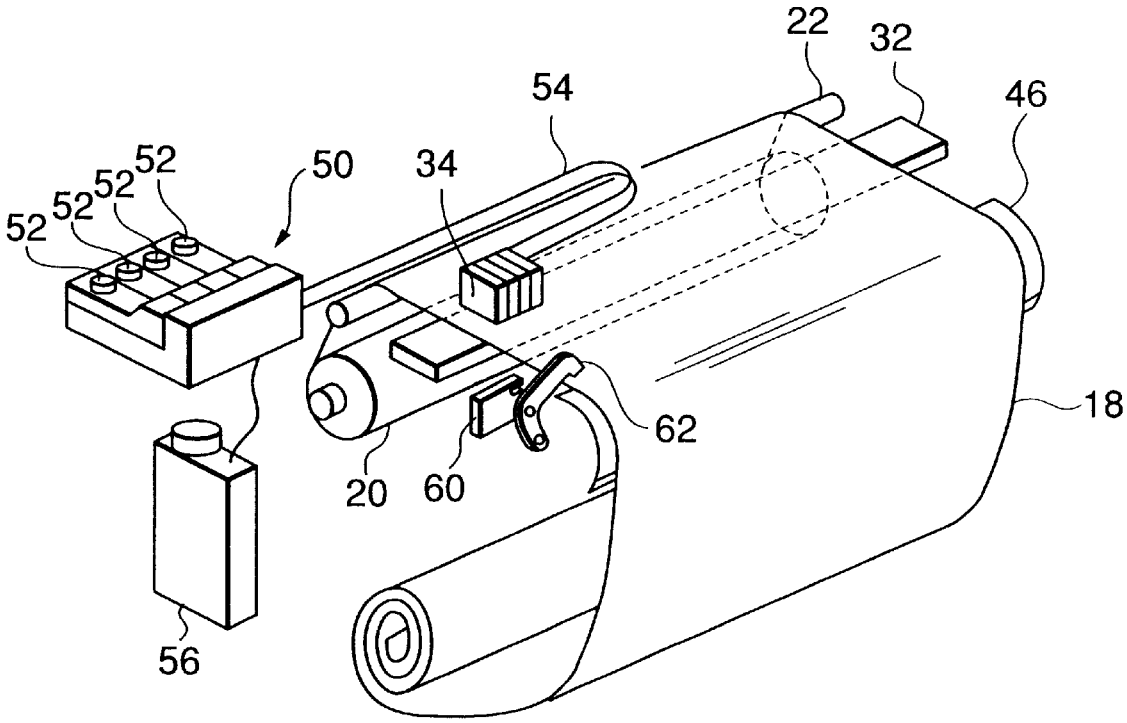
FIG. 2 is a perspective view illustrating an inner arrangement of main parts of the printer of the embodiment.

Numeral 50 denotes an ink tank device. As shown in FIG. 2, the ink tank device 50 is disposed on the rear face of the case 12, and includes four ink tanks 52 which can be detachably mounted from rear. The four ink tanks 52 contain inks of four colors corresponding to the four color ink ejecting nozzles of the print head 34, i.e., inks of cyan, magenta, yellow and black, respectively.

Pressurized air is supplied from the printer unit 10 to the ink tanks 52, and the inks of the tanks 52 are fed under air pressure to the print head 34. Numeral 54 denotes a bundle of four tubes for guiding the inks from the tanks 52 to the print head 34. Numeral 56 denotes a drain tank for collecting the waste inks which have been ejected for cleaning of the jetting nozzles of the print head 34.

A cutter device will next be described. A cutter 60 is disposed close to one edge of the printing sheet 18 between the guide plates 42, 44 and the guide plate 46. The cutter 60 cuts the printed sheet 18 while moving from the left end to the right. Additionally, since the printing sheet 18 has a broad width (about 54 inches at maximum), its cut portion hangs downward while the cutter 60 is moving, and its uncut portion is wrinkled. A clear cutting is thus impossible.

In the present invention, an end of the cut printing sheet is pressed or fixed by a pressing member or pressing lever 62 from above on the cutting start side of the cutter 60. Specifically, the guide plate 46 and the pressing member 62 serve as sheet holding means in the cutter device of the embodiment. When the cutter 60 reaches the terminal end of the printing sheet 18, the pressing lever 62 is raised to release the printing sheet 18. Therefore, since the right and left ends of the cut printing sheet 18 drop substantially simultaneously, printed sheets are orderly collected on the tray 48 without being wrinkled.

The cutter 60 will next be described with reference to FIGS. 3 to 5. The cutter 60 is held by a horizontal guide rail (not shown) in such a manner that it can horizontally move, and opposite ends of a wire 68 are fixed to the cutter 60. The wire 68 is wound around two pulleys 64, 66 positioned outside the entire width of the sheet 18. One pulley 64 is rotated forward or in reverse by a motor 70. As a result, the cutter 60 can be moved by the motor 70 to reciprocate in the width direction of the sheet 18. The cutter 60 preferably reciprocates to cut the sheet 18 at a speed of about 0.5 to 2.0 m/sec, and can preferably cut a 54 inch wide sheet in about one second.

Figure 4:
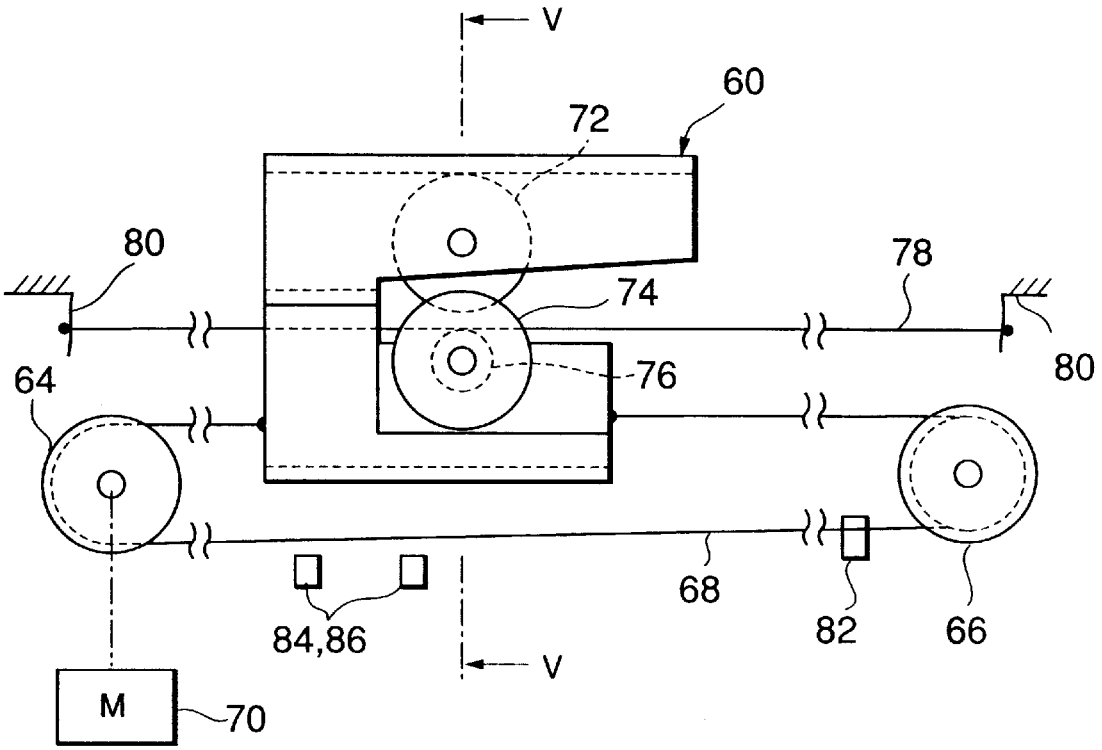
FIG. 4 is a front view of a cutter of the cutter device of FIG. 3.
Figure 5:
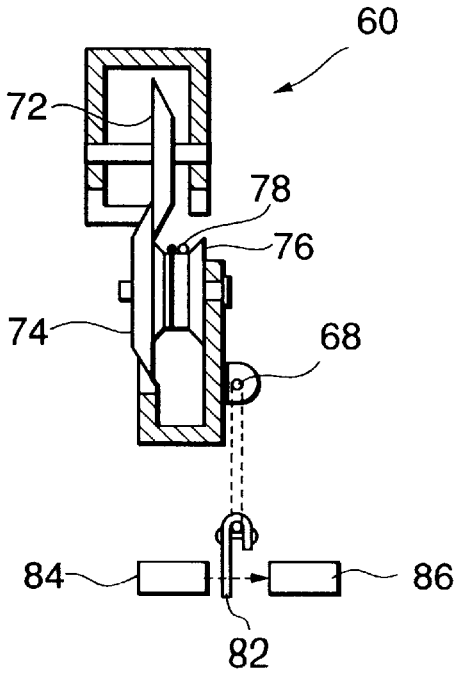
FIG. 5 is a sectional view taken along line V—V of FIG. 4.

The cutter 60 includes a pair of upper and lower rotating blades 72, 74, which slightly overlap each other in vertical direction as seen in the front view of FIG. 4. The overlapped portion of the blades 72, 74 is opposed to the left edge of the sheet 18. Additionally, rotating faces of the rotating blades 72, 74 are parallel with the width direction of the sheet 18. A pulley 76 having a diameter smaller than that of the lower rotating blade 74 is integrally fixed to the blade 74, and a wire 78 extended parallel with the wire 68 is wound around the small diameter pulley 76. Opposite ends of the wire 78 are fixed to frames 80, 80 of the printer unit 10 (FIG. 4).

Therefore, when the wire 68 runs in the width direction (transverse direction) of the sheet 18 by the rotation of the motor 70, the cutter 60 to which the opposite ends of the wire 68 are fixed moves right and left. Then, the pulley 76 of the rotating blade 74 moves relative to the fixed wire 78, the movement causes the pulley 76 to rotate and move on the fixed wire 78 and, consequently, the rotating blade 74 is rotated. Since the pulley 76 has a sufficiently smaller diameter than that of the rotating blade 74, the peripheral speed of the rotating blade 74 becomes sufficiently higher as compared with the travel speed of the cutter 60. When the upper and lower rotating blades 72 and 74 move from the left side toward the sheet 18 and the sheet 18 enters the overlapped portion of the rotating blades 72, 74, the sheet 18 is quickly cut between the rotating blade 74 rotating at a high speed and the upper rotating blade 72 rotated following the rotation of the blade 74.

The position of the cutter 60 may be detected by a photo sensor or the like. For example, when a light shielding plate 82 fixed to the wire 68 passes between a light emitting element 84 and a light receiving element 86 which are attached to a frame side, the position of the cutter 60 can be detected. In the embodiment the light emitting and receiving elements 84 and 86 are positioned in accordance with the width of the sheet 18.

Figure 3:
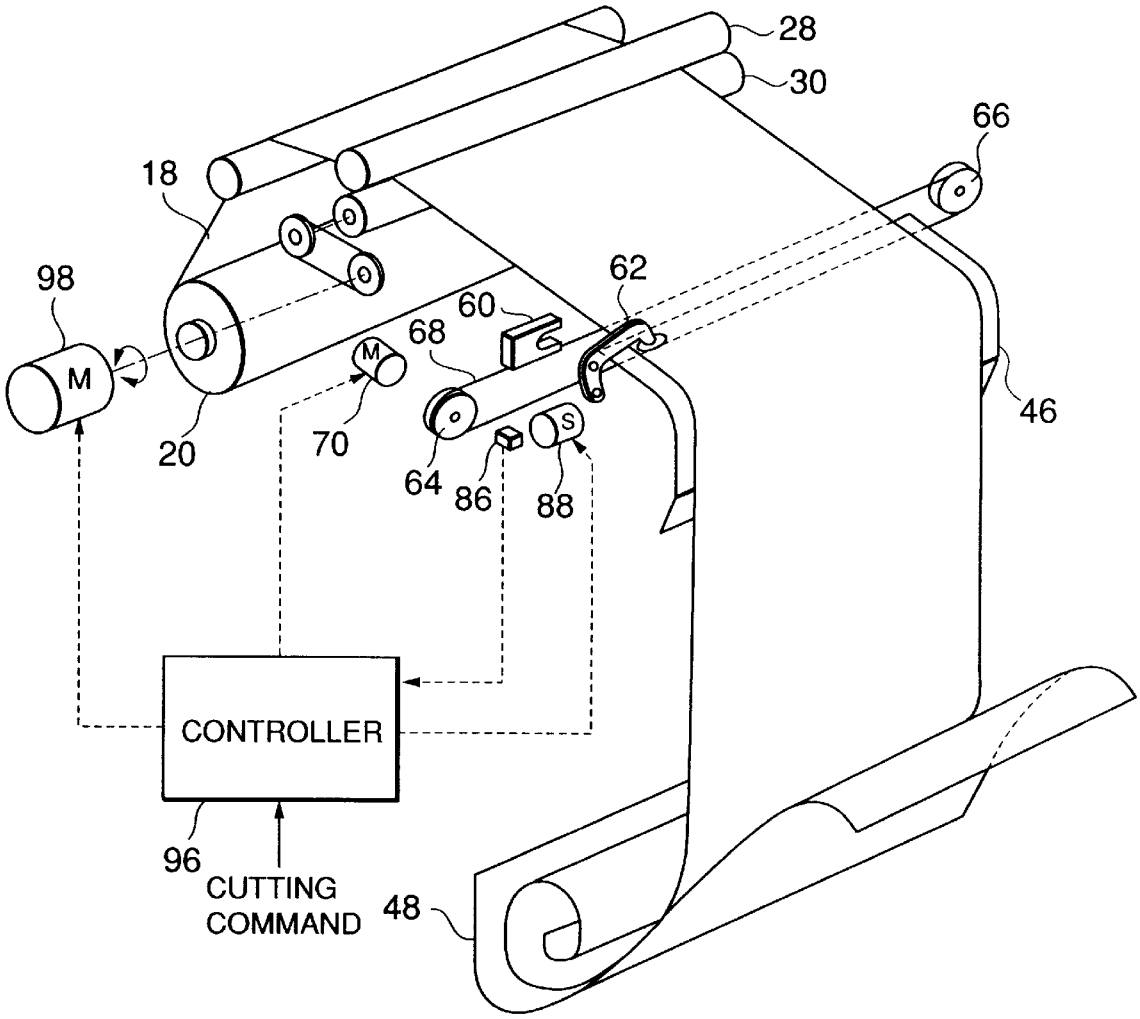
FIG. 3 is a schematic diagram showing the cutter device of the embodiment of FIG. 1.
Figure 6A:
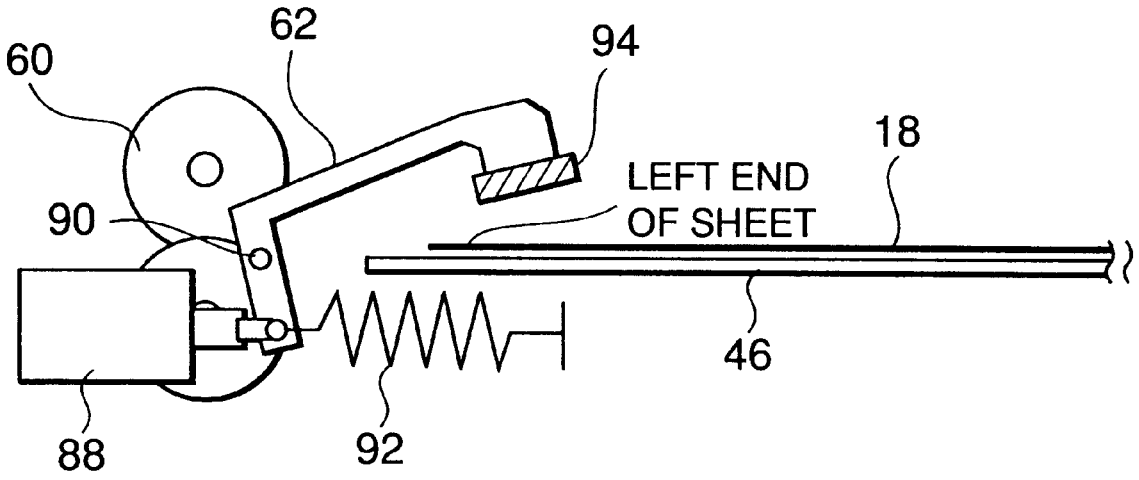
FIGS. 6A and 6B are descriptive diagrams showing the operation of a pressing lever of the cutter device, FIG. 6A showing a released sheet state and FIG. 6B showing a held sheet state.
Figure 6B:
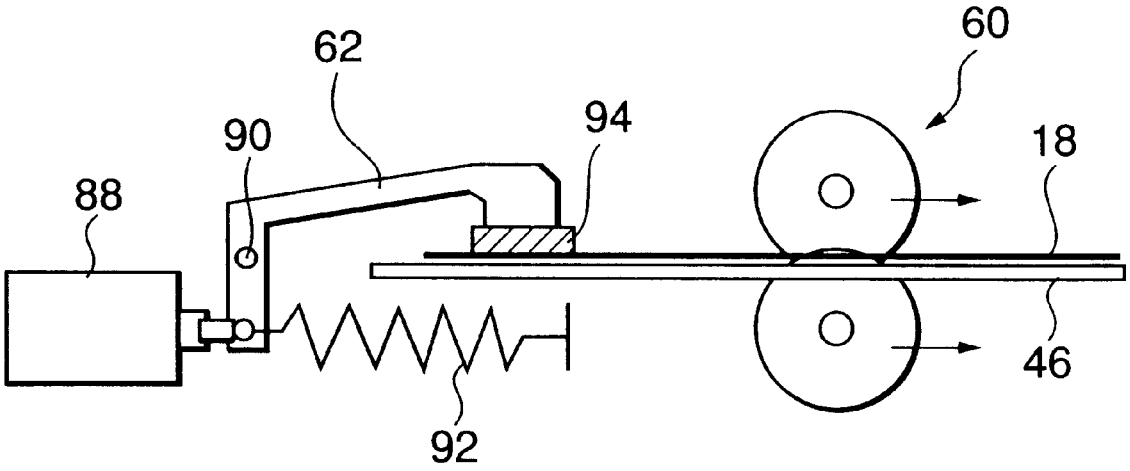

As shown in FIGS. 3, 6A and 6B, the pressing lever 62 as the pressing member is swung vertically by an electromagnetic solenoid 88. Specifically, the pressing lever 62 is formed like as a bell-crank which swings centering on a support 90, and has one end extended to above the left end of the printed sheet 18 and the other end pivoted or attached to a tip end of a plunger of the solenoid 88. The plunger tip end is biased in protruding direction by a tensile spring 92.

Therefore, at the time of non-excitation of the solenoid 88, the tensile spring 92 restores the plunger to its protruded position, and releases the extending end of the pressing lever 62 from the sheet 18 (as seen in FIG. 6A). Additionally, at the time of excitation of the solenoid 88, the plunger of the solenoid 88 is drawn into the solenoid 88 against the reset force of the tensile spring 92. The pressing lever 62 rotates in clockwise direction in FIG. 6B, and the extending end of the lever 62 presses the sheet 18 from above. Accordingly, the sheet 18 is held between the lever 62 and the guide plate 46. Additionally, the extending end of the pressing lever 62 may be provided with a pad 94 for increasing the friction with the sheet 18.

In FIG. 3, numeral 96 denotes a controller which controls the cutter 60 and the solenoid 88 in accordance with a cutting command entered from another control device, a manual switch, or the like. Moreover, when the cutting of the sheet 18 is completed to return the cutter 60 to its reset or home position, the sheet 18 is preferably fed in reverse by only a small amount in its rewinding direction in order to avoid interference of the cut end of the sheet 18, which is left on the side of the printer unit 10, with the cutter 60. In this case, the controller 96 supplies an instruction to a feed motor 98 to rotate in reverse so that the feed roller 30 is operated to rotate in reverse.

The entire operation will next be described with reference to an operation timing chart of FIG. 7. While image recording or printing is performed by the print head 34, the feed motor 98 (FIG. 3) rotates forward to feed the sheet 18 forward, i.e., in a direction in which the sheet 18 is drawn from the roll 20. After the recording (printing) is completed, upon receipt of a cutting command, the controller 96 (FIG. 3) further rotates the feed motor 98 forward by a predetermined amount until the cutting position of the sheet 18 reaches to the position of the cutter 60. After the positioning is completed (at timing $T_1$ of FIG. 7), the controller 96 excites the solenoid 88 to actuate the pressing lever 62 so that the sheet 18 is held between the pressing lever 62 and the guide plate 46.

In order to ensure the holding of the sheet 18 by the pressing lever 62, the controller 96 starts the movement of the cutter 60 with a slight delay ($t_1$) after the start of the excitation of the solenoid 88. Specifically, after the delay $t_1$, the controller 96 energize the motor 70 to move the cutter 60 at a high speed so that the sheet 18 is cut. The excitation of the solenoid 88 is stopped immediately before timing $T_2$ at which the cutter 60 reaches the right end (terminal end) of the sheet 18. Time $t_2$ is set in consideration of a delay from the time when the excitation of the solenoid 88 is stopped to release the pressing lever 62 from the sheet 18 to the time when the sheet 18 indeed starts dropping.

With such an operation, when the cutter 60 reaches the right end and finishes cutting, the left end of the sheet 18 is substantially simultaneously released from the pressing lever 62. Accordingly, the right and left ends of the sheet 18 start dropping substantially simultaneously before entering the tray 48. Therefore, during the cutting operation, there does not occur a problem such that only the left end of the cut sheet 18 drops while an uncut portion is wrinkled or surged. The cutter 60 can cut the sheet 18 straight with a clear cut line.

Subsequently, the cutter 60 returns from the right end to its reset or standby position on the left end, but prior to the returning, the controller 96 feeds the non-printed sheet 18 in reverse by a predetermined amount by rotating in reverse the feed motor 98 with a slight delay $t_3$ from the time at which the cutter 60 reaches the right end. By the reverse feeding, the cut end of the non-printed sheet 18 can be prevented from interfering with the returning cutter 60.

Figure 7:
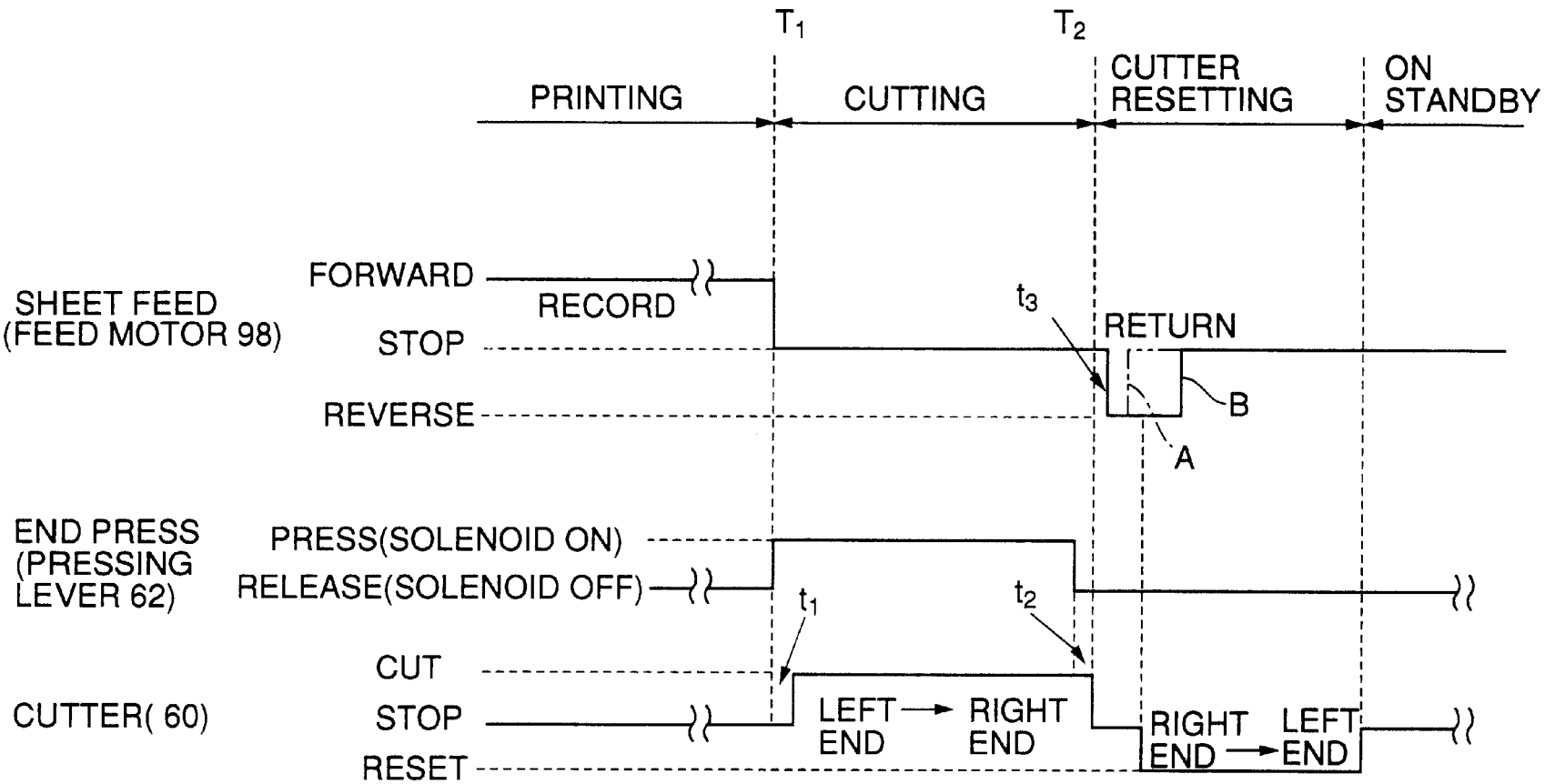
FIG. 7 is a timing chart of the entire operation of the cutter device.

The reverse feed amount may be an excessively small amount but enough to allow the cutter 60 to avoid the interference with the sheet 18 (dots and dash line A in FIG. 7). Otherwise, the sheet 18 may be returned to a position from which the next printing operation starts (solid line B in FIG. 7).

As aforementioned, just before the cutter 60 reaches the right end of the sheet 18 the excitation of the solenoid 88 is stopped and the sheet 18 is released from the pressing lever 62. The timing for stopping of the excitation of the solenoid 18 can be determined in various methods. For example, in a case where the travel speed of the cutter 60 (rotating speed of the motor 70) is considered to be constant, the timing can be determined by a time elapsed after the cutter 60 starts traveling. Additionally, by actually cutting the sheet 18, the timing can be manually set. Moreover, by detecting the position of the cutter 60 with the light emitting and receiving elements 84 and 86 described above or the like, the timing optimum for the sheet width may be determined.

In the embodiment, the pressing member is formed by the pressing lever 62 and swung by the solenoid 88, but the present invention is not limited thereto. It may essentially be a pressing member for holding the end of the sheet 18 to prevent the end from dropping. Therefore, the sheet may be pressed by a lever or a rod, but the sheet may be held by sucking the sheet by a negative suction pressure.

As aforementioned, in the present invention, the end of the sheet on the cutting start side is held or pressed and prevented from dropping, and the sheet is released from the pressing member substantially in synchronism with the time when the cutter reaches the end on the cutting completion side. Therefore, the sheet does not need to be pressed with a long member which transverses the sheet in its width direction, and the present invention is suitable for compactness of the device.

Additionally, since the end of the sheet is only pressed, a large space can be obtained above the sheet. Therefore, a new sheet can be easily set, and good operability can be provided.

Here, the sheet is preferably fed in reverse in its rewinding direction, within the time between after the cutter finishes cutting and before the cutter returns to its original position. With such a construction, the cut end of the non-printed sheet fails to interfere with the returning cutter, and the sheet is prevented from being damaged.

The cutter preferably includes rotating blades which rotate at a high speed accompanying the travel of the cutter, and cuts the entire width of the printing sheet at once at a high speed. As the cutting operation proceeds, the cut portion of the sheet increases and the weight of the cut portion of the sheet becomes heavier, resulting in the large application of the load to the uncut portion of the sheet. With high speed cutting operation by using rotating blades, the completion of the sheet cutting can be realized without damages of the sheet due to the excess load applied to the sheet in the position held by the pressing member. Also, the pressing force of the pressing member can be minimized. Additionally, the portion around the center of the sheet in its width direction can be securely prevented from hanging downward. In this case, the cutter can preferably finish cutting at once at a speed of about 0.5 to 2.0 m/sec.

What is claimed is:

1. A cutter device adapted for use in a printer in which a broad continuous printing sheet drawn from a horizontally placed roll is printed and the printed sheet is cut along a width direction, dropped downward and received by a tray, comprising:

a cutter disposed in the printer downstream from the roll and upstream from the tray, which reciprocates to cut the printed sheet in the width direction;

a guide plate disposed proximate to said cutter;

holding means adapted to be interposed between said cutter and said tray and adapted to hold the sheet only at one edge of the width direction against said guide plate to prevent the sheet from dropping at a cutting start side of said cutter; and a controller for allowing said holding means to hold a cutting start end of the printing sheet substantially in synchronism with a start of cutting by the cutter and for detaching said holding means from the printing sheet substantially in synchronism with completion of the cutting by said cutter;

wherein said guide plate guides the cut printing sheet to the tray after cutting.

2. The cutter device according to claim 1, wherein said holding means comprises:

a pressing member for pressing the printing sheet on a top surface at said edge of said sheet at the cutting start side of said cutter against said guide plate; and wherein said controller allows said pressing member to press the printed sheet substantially in synchronism with the start of the cutting by said cutter to hold the printing sheet between the pressing member and the guide plate, and detaches said pressing member from the printed sheet substantially in synchronism with the completion of the cutting by said cutter.

3. The cutter device according to claim 1, wherein the cutter comprises a rotating blade which rotates at a predetermined speed during travel of the cutter, and cuts the printing sheet while moving along an entire width of the printing sheet.

4. A cutter device adapted for use in a printer in which a broad continuous printing sheet drawn from a horizontally placed roll is printed and the printed sheet is cut along a width direction, dropped downward and received by a tray, comprising:

a cutter disposed in the printer downstream from the roll and upstream from the tray, which reciprocates to cut the printed sheet in the width direction;

holding means adapted to be interposed between said cutter and said tray and adapted to hold the sheet to prevent the sheet from dropping at a cutting start side of said cutter; and a controller for allowing said holding means to hold a cutting start end of the printing sheet substantially in synchronism with a start of cutting by the cutter and for detaching said holding means from the printing sheet substantially in synchronism with completion of the cutting by said cutter;

wherein, after the cutter finishes cutting the printing sheet, said controller feeds in reverse the printing sheet by a predetermined amount in a rewinding direction, before the cutter returns to the cutting start side.

5. A cutter device adapted for use in a printer in which a broad continuous printing sheet drawn from a horizontally placed roll is printed and the printed sheet is cut along a width direction, dropped downward and received by a tray, comprising:

a cutter disposed in the printer downstream from the roll and upstream from the tray, which reciprocates to cut the printed sheet in the width direction;

a guide plate disposed proximate to said cutter;

a holding mechanism adapted to be interposed between said cutter and said tray and adapted to hold the sheet only at one edge against said guide plate to prevent the sheet from dropping at a cutting start side of said cutter; and a controller for allowing said holding mechanism to hold a cutting start end of the printing sheet substantially in synchronism with a start of cutting by the cutter and for detaching said holding mechanism from the printing sheet substantially in synchronism with completion of the cutting by said cutter;

wherein said guide plate guides the cut printing sheet to the tray.

* * * * *